US009909327B2

(12) United States Patent
Klehr et al.

(10) Patent No.: US 9,909,327 B2
(45) Date of Patent: Mar. 6, 2018

(54) WALL FORMWORK WITH COUPLING DEVICE

(71) Applicant: Hunnebeck GmbH, Ratingen (DE)

(72) Inventors: Volker Klehr, Viersen (DE); Mike Berwig, Moenchengladbach (DE)

(73) Assignee: Hünnebeck GmbH, Ratingen (DE)

( * ) Notice: Subject to any disclaimer, the term of this patent is extended or adjusted under 35 U.S.C. 154(b) by 352 days.

(21) Appl. No.: 14/420,990

(22) PCT Filed: Aug. 8, 2013

(86) PCT No.: PCT/EP2013/066611

§ 371 (c)(1),
(2) Date: Feb. 11, 2015

(87) PCT Pub. No.: WO2014/026903

PCT Pub. Date: Feb. 20, 2014

(65) Prior Publication Data

US 2015/0204086 A1 Jul. 23, 2015

(30) Foreign Application Priority Data

Aug. 13, 2012 (DE) ..... 10 2012 214 396

(51) Int. Cl.
*E04G 11/06* (2006.01)
*E04G 17/04* (2006.01)
*E04G 9/02* (2006.01)

(52) U.S. Cl.
CPC ..... *E04G 11/06* (2013.01); *E04G 17/045* (2013.01); *E04G 2009/025* (2013.01)

(58) Field of Classification Search
CPC ..... E04G 11/06; E04G 17/045; E04G 11/082; E04G 11/08; E04G 17/00; E04G 17/02;
(Continued)

(56) References Cited

U.S. PATENT DOCUMENTS 3,550,898 A 12/1970 Ursini et al.
5,064,163 A 11/1991 Merkel
(Continued)

FOREIGN PATENT DOCUMENTS

CH 685453 A5 * 7/1995 ..... E04G 17/045
DE 2716864 A1 10/1978
(Continued)

OTHER PUBLICATIONS

Translation of WO1989001083.*
(Continued)

*Primary Examiner* — Matthew J Daniels
*Assistant Examiner* — Leith S Shafi
(74) *Attorney, Agent, or Firm* — Renner, Otto, Boisselle & Sklar, LLP

(57) ABSTRACT

According to the invention a wall formwork (1, 2) for the production walls consisting of concrete having a coupling device (4, 10), by means of which the wall formwork (1, 2) may be coupled to another wall formwork which is arranged adjacent or above is provided. The coupling device (4, 10) is—preferably detachably—coupled to the wall formwork (1, 2) and is especially coupled to a supporting element (2) of the wall formwork (1, 2). By "coupled" it is meant that the coupling device (4, 10) may even kept coupled to the wall formwork (1, 2) when the coupling device (4, 10) will not be used for coupling the wall formwork (1, 2) to another wall formwork. By way of coupling between the coupling device (4, 10) and the wall formwork (1, 2), during installation, a coupling device (4, 10) will immediately be available, if the wall formwork (1, 2) is to be coupled to another wall formwork by the coupling device (4, 10). By this, assembling will be promoted. Also realization of disassembling may be promoted, since the coupling device (4, 10) does not have to be deposited nor handled separately. For disassembling detachment of the coupling device (4, 10) from the wall formwork (1, 2) which is arranged adjacent or above will be sufficient.

22 Claims, 4 Drawing Sheets

Figure 1:
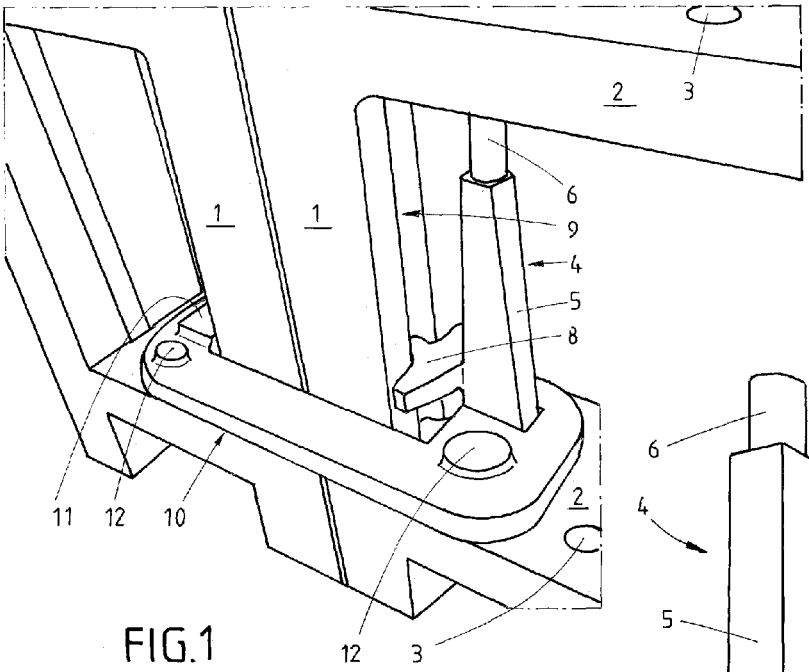

(58) Field of Classification Search
CPC ... E04G 17/04; E04G 17/065; E04G 17/0655; E04G 17/0651; E04G 17/12; B29C 33/202; B29C 2033/207; B29C 33/22; B29C 33/26; B28B 7/10; B28B 7/0014; B28B 7/0023; B28B 21/82
USPC ..... 249/22, 26, 33–39, 44, 47, 160–172; 425/63, 441–443; 403/373, DIG. 1, 403/DIG. 9, 321, 322.1, 322.4, 322.2, 403/322.3, 323, 324, 325, 326, 327, 330
See application file for complete search history.

(56) References Cited

U.S. PATENT DOCUMENTS

| | | | | |
|---|---|---|---|---|
| 5,174,909 | A | 12/1992 | Ward | |
| 5,294,157 | A * | 3/1994 | Smith | B01J 3/03 292/201 |
| 5,979,138 | A | 11/1999 | Allen | |
| 6,767,154 | B1 * | 7/2004 | Schwoerer | E04G 17/045 249/191 |
| 7,648,306 | B2 | 1/2010 | Schworer | |
| 2004/0069926 | A1 | 4/2004 | Ward | |

FOREIGN PATENT DOCUMENTS

| | | | |
|---|---|---|---|
| DE | 3604252 | A1 | 8/1987 |
| DE | 10047203 | A1 | 6/2001 |
| DE | 10330462 | A1 | 1/2005 |
| EP | 0037034 | B1 | 12/1983 |
| EP | 2039849 | A2 | 3/2009 |
| WO | 198901083 | A1 | 2/1989 |

OTHER PUBLICATIONS

Machine translation of CH 685453 A5.*
International Search Report and Written Opinion for corresponding patent application No. PCT/EP2013/066611 dated Oct. 29, 2013.
International Preliminary Report on Patentability, corresponding to PCT/EP2013/066611, dated Feb. 17, 2015.

* cited by examiner

FIG. 3
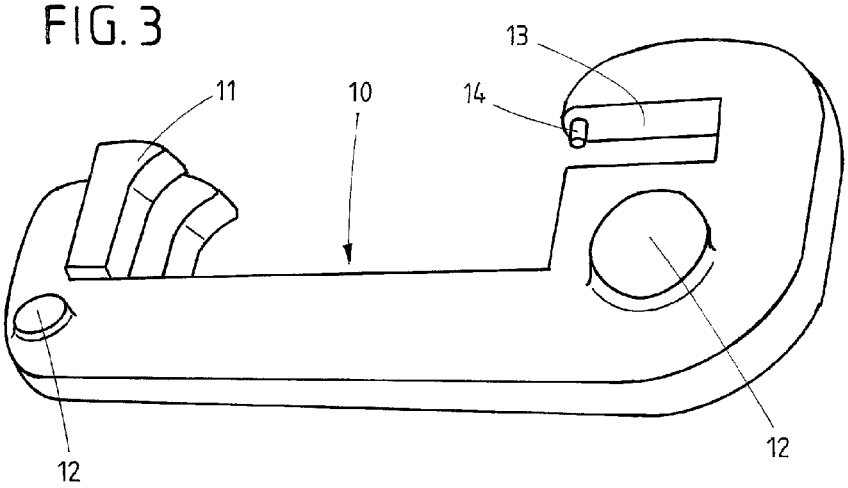
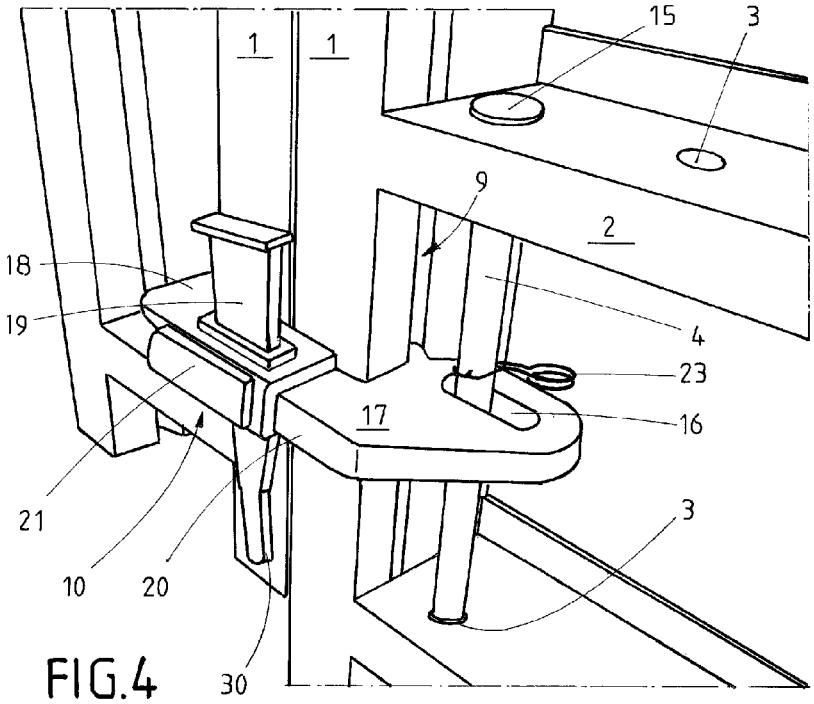
FIG.4

WALL FORMWORK WITH COUPLING DEVICE

The invention relates to a wall formwork with a coupling device for the production of walls consisting of concrete. Furthermore the invention relates to a coupling device for the wall formwork.

An anchoring system according to the present invention is used in formwork technology for a concrete casting process of reinforced concrete constructions. On the front side a wall formwork comprises a formwork facing and on the back side the formwork comprises supporting elements such as longitudinal beams, crossbars and frames for supporting the formwork facing. Both sides of a wall to be cast in concrete are encased by opposite wall formworks. The front side, i.e. the formwork facing of each wall formwork then will be adjacent to the concrete. Wall formworks which are opposite to each other are generally held by a multitude of anchoring systems. The anchor rods are passed through openings in the wall formworks and will be mounted at their ends to elements supporting the respective formwork facing such that at least the tensile force acting onto the anchor rods during concrete casting will be absorbed.

Generally both ends of the anchor rods have threads into which screw nuts are inserted as an anchor fixation. Basically the central area of an anchor rod to which, during concrete casting, concrete may be adjacent either has a smooth surface or at least will be encased by a bushing having a smooth surface.

Between the formwork facings spacers may be inserted into the volume of the wall to be cast which may absorb the compression forces emerging during casting, thereby assuring these compression forces not to affect the wall strength in an undesirable manner, i.e. reducing the wall strength. Alternatively or additionally the locking devices may be mounted onto the wall formworks so that the latter may also be able to absorb compression forces.

Wall formworks will not only be installed opposite to each other, but, in adaption to the dimensions of a wall to be produced, will also be installed adjacent and/or above each other, in order to obtain a larger total area which is provided by formwork facings abutting each other. Two wall formworks which are assembled adjacent to each other are coupled by one or more coupling devices for fixing the position and arrangement of the wall formworks. Such a coupling device is known from the document DE 103 30 462 A1 and is referred to as "tension lock device". It includes two clamps which are displaceable against each other. A wedge or the like is provided to displace both of the clamps for the coupling of two wall formworks such that said supporting elements of two wall formworks will be maintained in their desired position.

The features mentioned above which are known from prior art may individually or in any combination be combined with one of the following subject matters according to the invention described below.

It is an object of the invention to provide a wall formwork with a coupling device as well as an appropriate coupling device simplifying assembling and disassembling wall formworks.

In order to accomplish the object a wall formwork with a coupling device comprises the features of claim 1. The independent claim relates to a coupling device for such a wall formwork.

In order to accomplish the object a wall formwork with a coupling device for the production of walls consisting of concrete, by way of which coupling device the wall formwork is able to be coupled to another wall formwork which is arranged adjacent or above, is provided. The coupling device is—preferably detachably—coupled to the wall formwork, i.e. specifically to a supporting element of the wall formwork.

By "coupled" it is meant that the coupling device may even be kept coupled to the wall formwork if the coupling device is not used for connecting the wall formwork to another wall formwork. Consequently "coupled" also comprises the fact that the coupling device is or becomes connected to the wall formwork irrespective of the mounting status, respectively. Consequently said coupling does not have to be detached for assembling or disassembling, i.e. for example for coupling the wall formwork to a wall formwork which is arranged adjacent or above.

By "detachably and mechanically coupled" it is meant that the coupling device may at least be detached from the wall formwork by means of tools. Mechanical coupling is present if the coupling device will be coupled by form fitting and/or frictional connection to the wall formwork. According to the present invention an adhesive bond is not a mechanical coupling. Such a coupling device may be coupled to the wall formwork according to the invention.

Preferably the coupling device is coupled to the wall formwork so that no tool will be required for such detachment.

By coupling the coupling device to the wall formwork a coupling device will readily be available during assembling if the wall formwork is to be coupled to another wall formwork by the coupling device. This will promote assembling operation. Also disassembling may be promoted as separately depositing and handling the coupling device is not required. For disassembling detaching the coupling device from the wall formwork which is arranged adjacent or above will be sufficient.

Basically, as each supporting element consists of metal and always is at least mechanically stable enough to be able to assure reliable coupling, the coupling device preferably is mounted to a supporting element of the wall formwork.

Preferably the coupling device is detachably coupled to the wall formwork, in order to be able to couple it differently, as required, i.e. at a different site, to the wall formwork. Such a modification may be required if two wall formworks are to be coupled to each other in a new arrangement which requires the coupling device to be differently positioned. If the coupling may be detached without a tool assembling or disassembling may continue to be performed faster.

In one embodiment of the invention the coupling device is attached to two supporting elements of the wall formwork for coupling. This embodiment enables at least one component of the coupling device to be displaced between the two supporting elements in order to be able to arrange the coupling device during assembling in a more flexible manner and/or to bring the at least one component into its coupling position. This embodiment furthermore allows for suitably transmitting forces for coupling for example by way of a wedge-shape which is included in one component of the coupling device. Subsequently it will also be possible to variably arrange the other component(s) of the coupling device between the two supporting elements such that they may be positioned for flexibly coupling the wall formwork to another wall formwork, as required.

In one embodiment of the invention the coupling device includes a rod-like element—in the following also referred to as "rod"—which is coupled to two supporting elements of the wall formwork. The at least one other component of the coupling device is coupled to the rod and generally is at most displaceable coupled. Especially the at least one other component is coupled to the rod such that it may be displaced along the rod. The rod thus enables the at least one other component of the coupling device to be able to be displaced along the rod, such that this at least one other component may be positioned for flexibly coupling the wall formwork to another wall formwork, as required. Preferably displacement perpendicular to the rod and/or a tilting movement of the at least one other component of the coupling device in relation to the rod is possible. This allows for the at least one other component to be able to be suitably and better displaced for coupling to another wall formwork.

In one embodiment of the invention the rod passes through a hole, especially an elongated hole of the at least one other component of the coupling device. In this way the other one of the at least one other component is displaceable arranged along the rod. In addition, provision of an elongated hole advantageously enables displacement perpendicular to the rod of the at least one other component. In this way, for coupling the wall formwork to another wall formwork which is arranged above or adjacent, it will be enabled for the other component to be moved against the supporting element of the wall formwork such that upon coupling to another wall formwork the load which subsequently emerges will be absorbed by this supporting element of the wall formwork. It will thus be avoided that in case of coupling the load which emerges will be absorbed by the rod. The rod thus may be dimensioned and configured very small compared to the supporting elements, since in this embodiment the rod solely must absorb the load which has to be provided for permanently coupling the coupling device to the wall formwork. This will facilitate handling the coupling device.

For the sake of stability the rod preferably consists of metal. The at least one other component of the coupling device, which basically also consists of metal then will very reliably stay coupled to the wall formwork.

In one embodiment of the invention the rod passes into or through one or more holes of a supporting element of the wall formwork so as to be coupled to the supporting element(s). Since the rod basically may be removed from one or more holes, the coupling device then, according to the invention, will basically be detachably and mechanically coupled to the wall formwork.

In one embodiment of the invention the rod comprises a broadened area, preferably a broadened end, for example in the form of a disc which prevents the rod from being able to be passed through a hole of a supporting element which was mentioned above. If the rod will be passed through one or more holes of a supporting element, for example from the top, the broadened end finally serves as an abutment preventing further passing through. If the broadened area is distant from one end of the rod, the one end of the rod may initially be passed from the bottom through a hole of a supporting element until the other lower end of the rod will be above a hole of a supporting element situated below. If the rod will subsequently be moved downwards then at an appropriate length of the rod both ends of the rod will be held in holes of two supporting elements. The broadened area then also will prevent the rod from being displaced downwards to such a great extent that the upper end of the rod may be removed from the hole of the supporting element. According to the invention the rod now is coupled to two supporting elements and thus is coupled to the wall formwork.

In the case of the rod having the broadened area gravity may contribute to permanently coupling according to the present invention if, in the assembled state of a wall formwork, the broadened area prevents the rod from being able to be removed from one or more holes due to gravity. In the practice of the invention a wall formwork upon assembling and disassembling will, during concrete casting, always be held in such positions that a rod may not fall out of its hole due to gravity. It thus will not mandatorily be required that the rod may never fall out of its hole i.e. completely independent of the alignment of the wall formwork.

If one end of the rod is broadened, the length of the rod is preferably selected such that the other end of the rod passes into or through at least one hole of another supporting element. The rod then is coupled to two supporting elements of the wall formwork. In the erected state of a wall formwork the rod then will be held by gravity in its position.

In order to avoid the rod from being unintentionally removed from the one or more holes a pin or another fixing means is preferably provided which may be coupled to the rod such that unintentional removal or fall out of the rod may be prevented.

In one embodiment of the invention the rod is coupled to the at least one other component of the coupling device such that the at least one other component may be pivoted about the rod. This embodiment enables the at least one other component to be pivoted into its coupling position or may be pivoted out of its coupling position, respectively. By "coupling position" it is meant that the coupling device then couples two wall formworks to each other for concrete casting. In this embodiment handling is especially easy and comfortable.

In one embodiment of the invention the rod of the coupling device and an at least one other component of the coupling device is configured such that the at least one other component of the coupling device may be pivoted about the rod and thereby may be fixed in two different positions, i.e. on the one hand in a coupling position and on the other hand in a rest position. In the rest position the at least one other component is preferably aligned in relation to the wall formwork such that the coupling device then does not protrude opposite of the wall formwork or its supporting elements. By way of the fixation it will be accomplished that between disassembling and assembling operations the coupling device fixedly remains in its position thus avoiding disorders and risks of injury.

In one embodiment of the invention the coupling device comprises two clamps which are displaceable in relation to each other functioning for coupling two wall formworks. In the coupled state one clamp is in contact with a supporting element of the wall formwork and the other clamp is in contact with a supporting element of the other wall formwork, which is arranged above or adjacent to it. The coupling device then preferably comprises a wedge which for example is utilized in the way known from DE 103 30 462 A1 in order to move the two clamps towards each other for coupling two wall formworks.

In one embodiment of the invention each clamp of the coupling device has a nose or a protruding free end which in the coupled state of two wall formworks engages into a groove of a supporting element, as it is for example known from the document DE 103 30 462 A1.

In one embodiment of the invention the rod of the coupling device has at least one supporting element which perpendicularly protrudes from the rod towards a supporting element of the wall formwork and is supported by the latter at least when the coupling device couples two wall formworks to each other. A load which by way of coupling will be transmitted to the rod then will be transferred to a supporting element of the wall formwork by the supporting element of the coupling device. It thus will be assured that a load, which emerges due to a coupling between the two wall formworks will finally be absorbed by a supporting element of the wall formwork.

Preferably such a supporting element is cross-shaped or T-shaped and hence has laterally protruding bolts or noses. The bolts or noses which laterally protrude function for stabilizing the position of the supporting element and thus the position of the appropriate component of the coupling device, by bringing the laterally protruding bolts or noses in the coupling position into contact with the appropriate supporting element of the wall formwork.

In one embodiment of the invention the rod at least sectionally has the V-formation. The V-formation enables the at least one other component to move into its coupling position by way of displacing the at least one other component of the coupling device along the wedge thereby being able to also introduce high forces, in order to move the two wall formworks to be coupled into their final position for concrete casting.

In one embodiment of the invention the at least one other component has one or two reinforced areas, which are arranged and positioned such that for coupling by way of a hammer the at least one other component may be moved into its coupling position.

Moreover the invention relates to a coupling device for wall formworks having a rod, which may detachably and mechanically be coupled with at least one supporting element of the wall formwork, and at least another component by way of which two adjacent wall formworks may be coupled for concrete casting. As the rod may be coupled with a wall formwork promoting the assembling and disassembling operation will be enabled by the coupling device. The coupling device may have one or more features already disclosed in the context of a coupling device.

Preferably the at least one other component may be pivoted about the rod and the pivoting movement may be fixed in relation to the rod, i.e. preferably in two different positions. Especially pivoting of 180° will be required in order to move the other component from the one fixed position into the other fixed position. By fixing in at least one position it is especially possible for the at least one other component to be fixed in a rest position to thus reduce risk of injury. Fixing may for example be accomplished by way of a bolt which for fixing protrudes into a hole of the at least one other component. The bolt preferably is a component of the coupling device. Such a bolt may however be provided at the wall formwork. It is however less preferred that such a bolt will be provided at the wall formwork, as the wall formwork which already exists that has to be remodeled accordingly. The bolt may also be coupled to the at least one other component and in the fixed position may protrude into a hole, which may be a hole in a supporting element.

Preferably the coupling device comprises two clamps, which are displaceable towards each other, as well as a wedge by way of which the two clamps may be moved towards each other. By this coupling of two adjacent formworks will be enabled in a simple manner. Furthermore due to the wedge appropriately high forces may be introduced by way of hammer blowing in order to align two wall formworks during coupling.

The wedge generally is passed through by way of appropriate recesses at the clamps. In one preferred embodiment the end which has been passed through may comprise a laterally protruding bolt in order to securely couple the wedge to both clamps. The upper side of the wedge especially has a broadened area which also promotes securely coupling the wedge to the two clamps. Preferably this upper side is stably configured such that it may resist hammer blowing.

The wedge preferably comprises a hook-shaped end. The hook-shaped end contributes to that the wedge in a rest position of the coupling device may deposited onto the coupling device, i.e. especially such that the position of the wedge may subsequently be fixed.

Preferably the wedge is formed such that it may be fixed in a rest position of another component of the coupling device in an inclined position. For this purpose the wedge preferably comprises a supporting surface which in the fixed position of the wedge is extensively supported on a surface of another component. This embodiment further helps to avoid injuries due to wedge movements.

In one embodiment the rod of the coupling device is passed through an elongated hole of the one clamp. By this mobility of the at least one clamp for coupling two wall formworks will suitably be allowed.

The invention also relates to a coupling device for a system according to the claims having a fixing device, which mechanically and detachably may be coupled to at least one supporting element, especially a horizontally extending supporting element of the wall formwork. A horizontally extending supporting element extends horizontally in an erected state of the wall formwork for concrete casting. Especially the fixing device comprises a rod, which may be passed into and/or through a hole of a supporting element. Furthermore the coupling device comprises an additional component to which two adjacent wall formworks may be coupled for concrete casting. The other component may be pivoted in relation to the fixing device in order to be transferred from a parking position into a fixed position and vice versa. The coupling device furthermore comprises a holding device, in order to be able to hold the other component at least in the parking position. By this it is meant that in the parking position the other component will be assured against unscheduled pivoting. Risks of injury may thus be reduced and handling may be facilitated.

Preferably a pivoting movement from 160° to 200°, especially preferred from 170° to 190°, even more especially preferred from 180° will be required in order to transfer the other component from the fixed position into the parking position and vice versa. In this embodiment the other component is in the parking position at least close to or at least predominantly in the plane of the der wall formwork. Risks of injury may thus be further reduced for improvement, and handling may further be facilitated for improvement.

Preferably the rod comprises a section the cross section of which is adapted to the elongated hole already mentioned above of the clamp such that the pivoting movement about the rod of the at least one other component comprising said two clamps and said wedge may be prevented. This embodiment is especially advantageous for fixing the other component in the two different positions, parking position and fixed position, and holding them by way of the holding device, wherein a pivoting movement of 180° or at least almost 180° must be performed to transfer the other component from the fixed position into the parking position or vice versa. For this end the other component is lifted up opposite to said cross section, for example until the other component will be transferred into an area of the rod which allows pivoting. Now the 180° pivoting movement will be performed in order to be transferred into the second fixed position or parking position by lowering.

In one embodiment the holding device comprises an especially biased spring which is able to hold the other component in the parking position. In this embodiment the other component may be transferred into the fixed position against the spring force.

In one embodiment the holding device comprises a magnet, for holding the other component at least in the parking position by means of the magnet.

The holding device may also be part of the system comprising the coupling device in order to be able to advantageously hold the other component in the parking position. However, it is to be preferred that the holding device is a constituent of the coupling device since the coupling device allows holding the other component in a parking position independent of a wall formwork.

Figure 2:
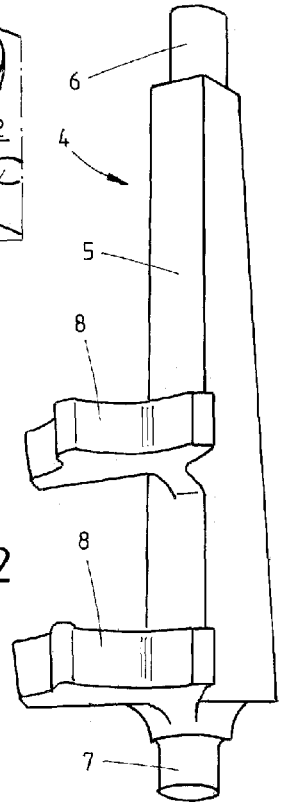
Figure 6:
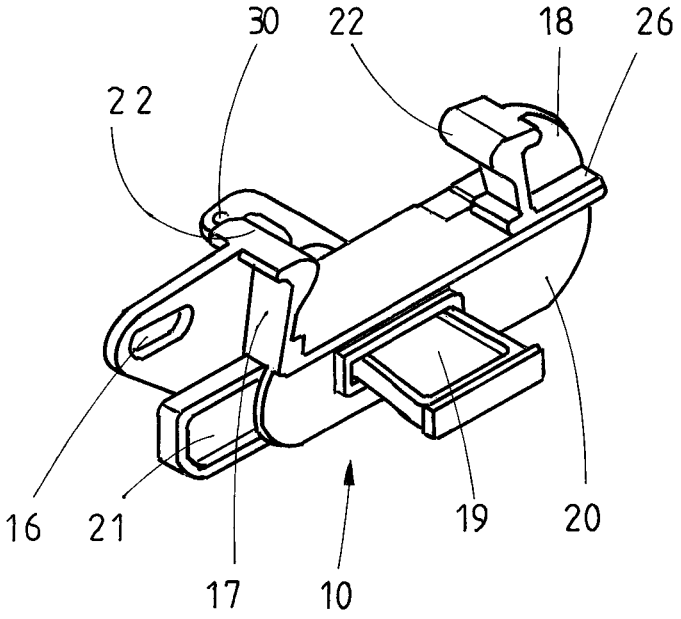
Figure 5:
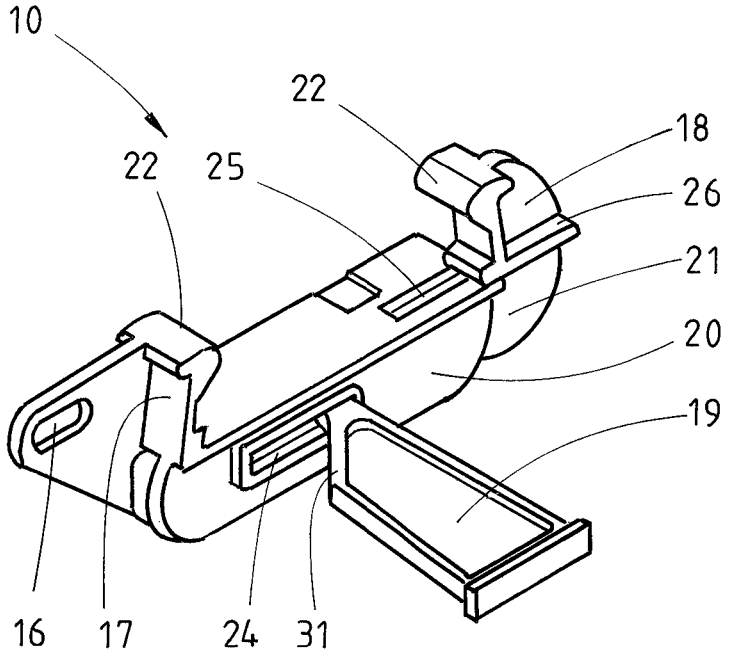
Figure 7:
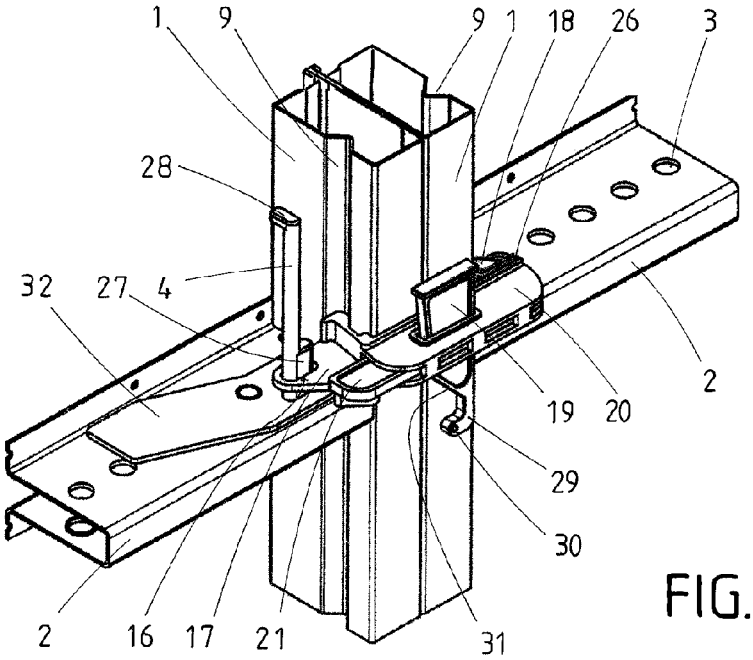
Figure 8:
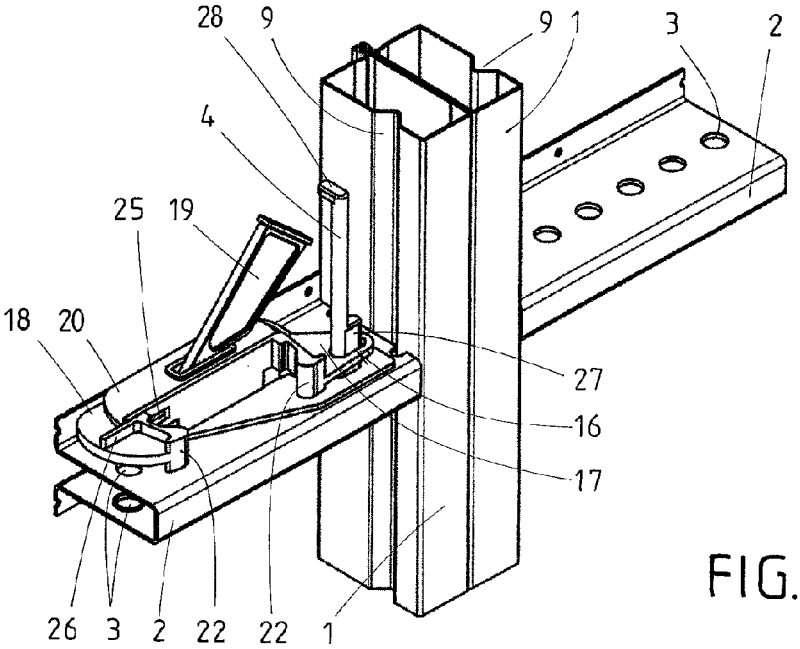

In the following the invention will be explained in detail by way of figures, wherein:

FIG. 1: is a system comprising a wall formwork and a coupling device;

FIG. 2: is a rod of the coupling device shown in FIG. 1;

FIG. 3: is another component of the coupling device shown in FIG. 1;

FIG. 4: is another embodiment of a wall formwork with coupling device;

FIG. 5: is another component of a coupling device with two clamps and a wedge;

FIG. 6: is another component according to FIG. 5 with the wedge being inserted;

FIG. 7: is a section of two wall formworks which are coupled to each other by a coupling device according to the FIGS. 5 and 6;

FIG. 8: is a coupling device in the rest position on a supporting element of a wall formwork.

FIG. 1 shows a first embodiment of the invention and particularly a coupling device in its coupling position. The coupling device also couples two wall formworks according to the present invention. A vertically extending supporting element 1 of a wall formwork as well as two horizontally extending supporting elements 2 coupled thereto are shown. The horizontally extending supporting elements 2 have a hat-shaped profile in cross section, such as especially set forth in FIGS. 7 and 8. Openings or holes 3, respectively, pass through this hat-shaped profile. A rod-like element 4 of the coupling device is mechanically coupled to the two horizontally extending supporting elements 2. The rod-like element 4 comprises a wedge-shaped broadened central area 5, which on top merges into a round rod 6. The round rod 6 has initially been inserted from the bottom into a hole 3 of the upper supporting element 2 of the wall formwork. A round rod 7 which can be seen in FIG. 2 is also connected to the wedge-shaped area 5 on the lower side. Compared to the lower round rod 6 the upper round rod 7 is longer, in order to be able to detachably couple the rod-like element to the wall formwork, as it is described. For this the upper round rod 6 initially is fully inserted from the bottom into a hole 3 of the upper supporting element. It will thus be accomplished to position the lower, relatively short round rod 7 above a hole 3 of the lower supporting element 2 of the wall formwork. If the rod-like element 4 will subsequently be lowered the lower round rod 7 will also be inserted into the hole 3. This lowering will be completed as soon as the lower area of the wedge shape 5 abuts to the lower supporting element 2 and will prevent further lowering. This lowering does not result in the upper round rod 6 to be displaced out of its hole 3. In the erected state of the wall formwork the rod-like element 4 will therefore be mechanically, i.e. according to the present invention detachably, coupled to the wall formwork.

The rod-like element 4 has two supporting elements 8 on, i.e. in the lower half of the wedge 5, which abuts to the lower, relatively short round rod 7. The two supporting elements 8 perpendicularly protrude from the rod-like element 4 towards the vertically extending supporting element 1 of the wall formwork and in the mounted state will be in contact with the supporting element. The free front end of each supporting element 8 protrudes into a groove 9 of the vertically extending supporting element 1. The two free ends of each supporting element 8 which laterally protrude abut to the outer surface of the vertically extending supporting element 1 of the wall formwork. The desired position of the rod-like element 4 thus will be stabilized. The two supporting elements 8 transmit load exerted on the rod-like element 4 which emerges in the mounted state to the vertically extending supporting element 1. The rod-like element 4 thus may be less stable than the supporting element 1.

Positioning of the two supporting elements 8 is especially selected such that the load, in the coupled state, will be transmitted to the area of the rod 4 which is between the two supporting elements 8, by two wall formworks. This embodiment will most reliably and suitably transfer a load to a supporting element 1 of a wall formwork.

In addition to the rod-like element 4 the coupling device comprises one other component 10, which movably is coupled to the rod-like element 4. The other component 10, in the mounted state, surrounds a vertically extending supporting element 1 of another wall formwork, which is arranged adjacent to it, by a hook-shaped end 11 The hook-shaped end 11 protrudes into a groove 9 which is provided (cf. FIGS. 7 and 8) of the vertically extending supporting element 1 of the other wall formwork after the two wall formworks have been coupled to each other by the coupling device.

The other component 10 may be moved back and forth along the rod-like element 4 between the two horizontally extending supporting elements 2. If the other component 10 is in the upper area at the round rod 6, the hook-shaped end 11 may be removed from its groove and subsequently the other component 10 may be pivoted about the round rod 6 and away from the vertically extending supporting element 1 of the other wall formwork. By this, the coupling between the two wall formworks will be detached.

If the other component 10 will be moved downwards starting from the round rod 6 die wedge-shape of the area 5 provides for the hook end 11 to be displaced towards the wall formwork having the supporting elements 1 and 2, in order to securely couple the two wall formworks to each other. In order to be able to exert a strong force for the sake of alignment of the two wall formworks during assembling the other component 10 has two reinforced areas 12 which are provided for the downward movement of the other component 10 by way of hammer blowing into its final coupling position. Reinforcement preferably will be realized by way of plate-shaped protrusions 12.

The area of the other component 10 adjacent and coupled to the rod-like element 4 has a recess 13 which is shown in FIG. 3 surrounding the rod-like element 4. The width of this recess is adapted to the width of the wedge 5. Advantageously wedge 5 thus provides for the other component 10 to appropriately be and stay aligned for coupling. By way of this recess 13 shown in FIG. 3 the rod-like element 4 may be passed through. However, a protruding pin 14 prevents the other component 10 from being able to be detached by laterally displacing the rod-like element 4. The recess in combination with the pin thus corresponds to an elongated hole (slot). An elongated hole thus does not strictly have to show a closed shape. The depth of the recess 13 is selected such that the other component 10 may also be displaced in the horizontal direction in order to thus be transferred to and removed from the coupling position.

The coupling device according to the FIGS. 1-3 may detached from the wall formwork without a tool. For example with the round rod 6 a pin may be provided below the upper supporting element 2 preventing unintentional detachment.

In FIG. 4 another embodiment is shown. A round rod 4 of the coupling device has been passed from the top through a hole 3 of the upper horizontally extending supporting element 2. The rod 4 is long enough such that it may also protrude into a hole 3 of a supporting element 2 which is below. On top of rod 4 a plate-shaped broadened end 15 is arranged which prevents the rod 4 from falling through holes 3 due to gravity. If the plate-shaped end 15 will be supported by the supporting element 2, then the lower end of the rod 4 advantageously will protrude into an appropriate hole 3 of the supporting element 2 which is arranged below.

Another component 10 of the coupling device has an elongated hole 16 through which the rod 4 is passed. Due to the elongated hole 16 the other component 10 may be moved back and forth along the rod 4 between the two supporting elements 2 as well as may be moved in a horizontal direction. Moreover the elongated hole 16 allows a tilting movement.

The other component 10 consists of three parts, i.e. a first clamp 17, a second clamp 18 as well as a wedge 19. A leg 20 of the clamp 17 may be inserted into a leg 21 of the clamp 18 such that the two clamps 17 and 18 may be moved towards each other and away from each other. The two legs 20 and 21 have passages into which wedge 19 protrudes. The passages are adapted to the wedge-shape such that the wedge is appropriately guided. Especially, dimensions of the passages are such, that downwardly displacing the wedge 19 for example by way of a hammer through the respective openings or passages 24, respectively, (cf. FIG. 5) results in moving the two clamps 17 and 18 towards each other for coupling the two wall formworks to the vertically extending supporting elements 1.

The two clamps 17 and 18 have protruding noses 22, engaging the grooves 9 of the vertically extending supporting elements 1 of the two wall formworks in the coupled state. By way of a pin 23 the rod 4 will be secured against falling out of its coupled position.

The embodiment shown in FIG. 4 is mechanically coupled to the wall formwork according to the invention, comprising supporting elements 1 and 2. Nevertheless the coupling device 10 may be detached from this wall formwork without any tool.

In FIG. 5 a modified, especially preferred embodiment of a coupling device is represented, similar to that shown in FIG. 4. The leg 21 of the clamp 18 is displaceable inserted into the leg 20 of the clamp 17. The clamp 17 comprises the elongated hole 16. With such a coupling device a slot 25 is preferably provided at the free end of the leg 20 such that the clamp 18 may also be inserted into the slot 25 with the area which faces away from leg 21. This allows especially elongated legs 20 and 21 of the two clamps 17 and 18, which hence may mechanically and especially stably be coupled to each other allowing an especially large displacement path. In such an embodiment in the coupled state, with the clamp 18, there is preferably an abutting surface 26 which generally at least in the mounted state abuts to the surface of the leg 20. In this way coupling by the coupling device will further be improved and mechanically stabilized, since the two clamps 17 and 18 are held especially stably.

In FIG. 6 it is exemplified how passing the wedge 19 through the respective openings 24 makes the two clamps 17 and 18 move towards each other until finally the abutting surface 26 preferably provided of the clamp 18 abuts to the leg 20 of the clamp 17 thus stabilizing the position. The leg 21 then passes through the leg 20

In the FIGS. 7 and 8 a further improved embodiment of a rod 4 of a coupling device especially according to the FIGS. 5 and 6 roof is exemplified. The rod 4 in the lower area 27, which is supported by a horizontally extending supporting element 2 having a hat profile, has an elongated cross section corresponding to the form of the elongated holes 16. Below area 27 having the elongated cross section the rod 4 protrudes into a hole 3 or passes through it. An end which passes through of the rod 4 may be secured below the supporting element 2, for example by way of a pin, against the rod 4 falling out of the hole.

By way of the section or the area 27, respectively, having the elongated cross section the position of the coupling device may be fixed in two different positions, on the one hand, according to FIG. 7, in the position, where the coupling device couples the two wall formworks having the supporting elements 1 to each other. The second way of fixation is shown in FIG. 8. In this position the two wall formworks are not coupled to each other by the coupling device. Instead the coupling device is fully supported by the supporting element 2 of the wall formwork having the vertically extending supporting element 1 and is secured against pivoting. This position shown in FIG. 8 will be adopted following disassembling, if wall formworks have to be handled for reassembling. By this, risk of injury will be reduced and handling will be facilitated.

As it is exemplified in FIGS. 7 and 8 a rod 4 may solely be fixed to one supporting element 2. In this case the rod 4 on its upper end preferably has a crossbar 28 or a differently shaped broadening, respectively, which at least hampers displacement of the coupling device out of the rod, in order to prevent loss of the other component(s) 10. The crossbar 28 or the differently shaped broadening, respectively, may be dimensioned such that with the coupling device being appropriately aligned the elongated hole 16 may be moved out of the rod 4. The bar 28 or the differently shaped broadening, respectively, may however be dimensioned such that the other component(s) 10 may no longer be detached from the rod 4 if the rod 4 is secured to a supporting element 2. Then the other component 10 is maximally protected against loss.

Advantageously the wedge 19 has a hook-shaped end 29, especially having a laterally protruding bolt 30, by way of which the wedge 19 is undetachably and thus advantageously securely coupled to the two clamps 17 and 18. The hook-shaped end 29 allows the wedge 19 to be fixedly supported in an inclined position, as it is shown in FIG. 8.

Advantageously for this end the wedge 19 alternatively or supplementary has an obliquely extending supporting surface 31 stabilizing the position of the wedge 19 in its rest position according to FIG. 8. In the oblique position which is shown the wedge 19 advantageously does not prevent the other components 10 from being extensively supported by a supporting element 2 according to FIG. 8.

The coupling device may furthermore comprise a supporting surface 32 onto which the at least one other component 10 of the coupling device may be deposited in the rest position. The supporting surface 32 preferably is abutting to the supporting element 2 of the wall formwork. The supporting surface 32 advantageously provides for the elements such as nose 22 of the clamp 18 to have a distance sufficiently large from the supporting element 2 in der rest position shown in FIG. 8. The supporting surface 32 thus also has a protective function.

The invention claimed is:

1. A system for the production of walls made of concrete including a wall formwork and a coupling device, by means of which the wall formwork may be coupled to another wall formwork which is arranged adjacent or above, wherein the coupling device is coupled or is connectable detachably and mechanically, to the wall formwork wherein the coupling device has a fixing device which may mechanically and detachably be coupled to at least one supporting element of the wall formwork, and at least another component, by means of which the two adjacent wall formworks for the concrete casting may be coupled, wherein a holding device for holding the at least one other component in a parking position in part of the system, wherein the holding device comprises a magnet or a spring which is able to hold the other component in the parking position, in which the two wall formworks are not coupled to each other by the coupling device.

2. The system according to claim 1 wherein the other component may be pivoted in relation to the fixing device in order to be transferred from the parking position into a fixed position and vice versa.

3. The system according to claim 1 wherein the other component is assured against unscheduled pivoting in the parking position.

4. The system according to claim 1 wherein the other component is in the parking position at least predominantly in the plane of the wall formwork.

5. The system according to claim 1 wherein the holding device comprises the spring, which is a biased spring to hold the other component in the parking position.

6. The system according to claim 1 wherein the coupling device comprises the holding device.

7. The system according to claim 1, wherein the coupling device is mounted to two supporting elements of the wall formwork.

8. The system according to claim 7, wherein a rod of the coupling device is mounted to one or two supporting elements of the wall formwork and at least one other component of the coupling device is movably coupled to the rod.

9. The system according to claim 1, wherein the coupling device comprises a component which has an elongated hole through which a rod of the coupling device is passed.

10. The system according to claim 1, wherein at least one component of the coupling device may be moved against a supporting element of the wall formwork such that the at least one component is able to transmit the load to the at least one supporting component which emerges if the wall formwork is or becomes coupled to another wall formwork by the coupling device.

11. The system according to claim 1, wherein the coupling device comprises a rod having a broadened area such that the rod but not the broadened area may be passed through a hole at a supporting element of the wall formwork.

12. The system according to claim 11, wherein the broadened area is wedge-shaped.

13. The system according to claim 1, wherein the fixing device comprises a rod.

14. The system according to claim 13, wherein the at least one other component may be pivoted about the rod and the pivoting movement may be fixed in relation to the rod, and is fixed in two different positions.

15. The system according to claim 1, wherein the coupling device comprises two clamps, which are displaceable in relation to each other, as well as a wedge, by means of which the two clamps may be moved towards each other.

16. The system according to claim 15, wherein the wedge comprises a hook-shaped end.

17. The system according to claim 16, wherein the rod of the coupling device is passed through an elongated hole of the one clamp.

18. The system according to claim 17, wherein the rod comprises a section, the cross section of which is adopted to the elongated hole such that a pivoting movement of the at least one other component of the coupling device about the rod may thereby be prevented.

19. The system according to claim 1, wherein a wedge of the coupling device, which is configured such that it may be fixed in an oblique position when an at least one other component of the coupling device is in a rest position.

20. The system according to claim 15, wherein a supporting surface is abutting a supporting element of the wall formwork to provide for a nose of the clamp to have a distance from said supporting element in the parking position.

21. The system according to claim 20, wherein the supporting surface is abutting to a horizontally extending supporting element of the wall formwork, wherein a horizontally extending supporting element extends horizontally in an erected state of the wall formwork for concrete casting.

22. The system according to claim 3, wherein the other component is in the parking position at least predominantly in the plane of the wall formwork.

* * * * *